US009770613B2

(12) United States Patent
Kadoche

(10) Patent No.: US 9,770,613 B2
(45) Date of Patent: Sep. 26, 2017

(54) FIREFIGHTING INSTALLATION INCLUDING A NETWORK OF VACUUM SPRINKLERS THAT CAN BE TRIPPED BY AN ACTUATOR OPERATED BY A MEMBRANE-MASTER ACTUATOR

(71) Applicants: VACTEC, Saint Florent sur Cher (FR); Maurice Kadoche, Coubron (FR)

(72) Inventor: Maurice Kadoche, Coubron (FR)

(73) Assignees: VACTEC, Saint Florent sur Cher (FR); Maurice Kadoche, Coubron (FR)

( * ) Notice: Subject to any disclaimer, the term of this patent is extended or adjusted under 35 U.S.C. 154(b) by 94 days.

(21) Appl. No.: 14/769,726

(22) PCT Filed: Feb. 13, 2014

(86) PCT No.: PCT/FR2014/050285
§ 371 (c)(1),
(2) Date: Aug. 21, 2015

(87) PCT Pub. No.: WO2014/128388
PCT Pub. Date: Aug. 28, 2014

(65) Prior Publication Data

US 2016/0008643 A1 Jan. 14, 2016

(30) Foreign Application Priority Data

Feb. 21, 2013 (FR) ..... 13 51519

(51) Int. Cl.
*A62C 35/62* (2006.01)
*A62C 35/68* (2006.01)

(52) U.S. Cl.
CPC ..... *A62C 35/62* (2013.01); *A62C 35/68* (2013.01)

(58) Field of Classification Search
CPC ..... A62C 35/62; A62C 35/64; A62C 35/68
See application file for complete search history.

(56) References Cited

U.S. PATENT DOCUMENTS 2,357,133 A 8/1944 Rider
2,699,217 A 1/1955 Elmenhorst
(Continued)

FOREIGN PATENT DOCUMENTS

FR 2724323 A1 3/1996

OTHER PUBLICATIONS

International Search Report dated Oct. 16, 2014 for corresponding International Application No. PCT/FR2014/028388, filed Feb. 13, 2014.

(Continued)

*Primary Examiner* — Christopher Kim
(74) *Attorney, Agent, or Firm* — David D. Brush; Westman, Champlin & Koehler, P.A.

(57) ABSTRACT

A firefighting installation includes a network of vacuum sprinklers. The installation incorporates a trip device that triggers the application of water to the network of sprinkler. The trip device includes: a master actuator sensitive to pressure present in the sprinkler network and capable of moving a yoke from a first to a second position; a lock for locking a member of the actuator in position; and a transmission member transmitting between the yoke and the locking means. The master actuator includes a membrane able to move between a first position corresponding to the sprinkler network being under vacuum and a second position corresponding to the sprinkler network being subject to atmospheric pressure, the first and second positions of the membrane corresponding to the first and second positions of the yoke.

16 Claims, 4 Drawing Sheets

(56) References Cited

U.S. PATENT DOCUMENTS

| | | | |
|---|---|---|---|
| 2,865,457 | A | 12/1958 | Jensen |
| 3,759,331 | A | 9/1973 | Livingston |
| 7,673,695 | B2 | 3/2010 | Deurloo |
| 2009/0236104 | A1 | 9/2009 | Banis et al. |

OTHER PUBLICATIONS

English translation of the Written Opinion dated Aug. 21, 2015 for corresponding International Application No. PCT/FR2014/028388, filed Feb. 13, 2014.
Office Action dated Apr. 28, 2017 for U.S. Appl. No. 14/769,733, file Aug. 21, 2015.

FIREFIGHTING INSTALLATION INCLUDING A NETWORK OF VACUUM SPRINKLERS THAT CAN BE TRIPPED BY AN ACTUATOR OPERATED BY A MEMBRANE-MASTER ACTUATOR

CROSS-REFERENCE TO RELATED APPLICATIONS

This Application is a Section 371 National Stage Application of International Application No. PCT/FR2014/050285, filed Feb. 13, 2014, the content of which is incorporated herein by reference in its entirety, and published as WO 2014/128388 A2 on Aug. 28, 2014, not in English.

FIELD OF THE DISCLOSURE

The field of the invention is that of designing and manufacturing firefighting equipment and installations. More precisely, the invention relates to a trip device designed for "vacuum" firefighting installations.

BACKGROUND OF THE DISCLOSURE

The role of an automatic fire extinguishing installation implementing sprinklers is to detect, as early as possible, the seat of a fire then to automatically trigger the extinction system, at least locally, this while emitting an alarm. The installation has for objective to contain the fire as much as possible, before the arrival of the fire brigade which then takes over the installation in order to extinguish the fire.

In the field of the invention, firefighting installations are classified into three categories, namely:

"wet-pipe" systems;

"dry-pipe" systems;

"vacuum" systems.

In these three systems, the sprinklers are mounted in a network in such a way as to be distributed evenly over the site to be protected. Conventionally, the sprinklers comprise:

- a fixing connector, that allows the sprinkler to be connected to pipework, with this fixing connector having a nozzle intended for the passage of water to be released in order to extinguish the fire;
- a fusible member;
- a shutoff member for shutting off the nozzle, held in the shutoff position by the fusible member.

The fusible member is calibrated to blow when a certain temperature has been exceeded, as such releasing the nozzle from its shutoff member.

In "wet-pipe" systems, the entire piping of the installation is filled with water, and this up to the sprinklers. The water is therefore on standby behind the shutoff means and when the fusible member blows, the water flows through the nozzle of the connector of the sprinkler of which the fusible member has blown.

The release time for the water is therefore immediate, which is particularly advantageous. On the other hand, "wet-pipe" systems, are not adapted for sites that have risks of freezing. Indeed, in case of freezing, the water cannot flow. In addition, the freezing can cause deteriorations to the piping of the installation (deformation and even bursting of the pipes). In certain cases, the installation is emptied of water. In other cases, the site to be protected is heated in order to prevent any risk of freezing. For sites to be protected that have a relatively substantial surface area, the consumption of energy, and consequently the heating bill, can be substantial, and even prohibitive. Another way to fight freezing is to add an antifreeze agent to the water of the installation, such as glycol which is a toxic and carcinogenic product.

In the "dry-pipe" systems, the entire installation is emptied of water. The entire piping of the installation is kept under pressure. When the fusible members blow, the air pressure is released by the sprinkler or sprinklers in question and the water, also under pressure, tends to "push" the air outside of the installation until it arrives at the orifice or orifices released in such a way as to escape through the latter.

With such a system, the water can in certain cases take up to 60 seconds to reach the sprinkler of which the fusible member is blown, which is of course compliant with the current standard but which can be excessively long with regards to certain incipient fires.

In addition, "dry-pipe" systems do not entirely overcome the problems linked to freezing. Indeed, condensation can be created in the piping of a "dry-pipe" installation, which can damage certain components of the installation and cause the protection to fail.

Generally, "wet-pipe" and "dry-pipe" systems have the following disadvantages:

- they are subject to forming slush and, consequently, to clogging;
- they are subject to corrosion, which can obviously lead to an installation partially or entirely out of use and cause the protection to fail;
- they can be the object of water leaks that cannot be seen;
- they allow the development of microorganisms in the pipes of the installation.

This results in that they require, among other things, antifreeze and anticorrosion treatments (involving recourse to harmful products).

Moreover, they require rinsing operations after use.

Furthermore, they imply putting into service times that are relatively long, according to the extent of the installation, which can range from one to four hours for "wet-pipe" systems and two hours and more for the "dry-pipe" systems.

In order to overcome all of these disadvantages, "vacuum" systems were designed. In "vacuum" systems, a vacuum is created in the pipes extending between a general valve and all of the sprinklers. In other terms, all of the pipes separating the valve from the sprinklers are in a vacuum.

In these systems, the vacuum constitutes an active energy which is used as a functional source in monitoring sprinklers. Indeed, if a fusible member of one of the sprinklers blows, the atmospheric pressure reaches the entire installation, which causes a change in the state of an actuator which, in turn, opens the general water inlet valve. Then the water quickly and without any obstacle invades the entire installation until the sprinklers, with the water flowing through the sprinkler or sprinklers of which the fusible member has blown. The vacuum which is still active in the networks quickly attracts the extinguishing water towards the sprinklers of which the fusible member has blown.

The triggering time of the actuator is very short, in that, when a fusible member blows, the "vacuum" installation immediately generates an aspiration phenomenon of the air outside of the installation. Note that this aspiration can be beneficial, as the aspiration effect on the seat of the fire tends to reduce the intensity of the latter.

The time for the water to arrive at the sprinkler of which the fusible member has blown is less than 60 seconds.

It is therefore understood that, due to the absence of water or of condensation in a "vacuum" system installation, the following results are obtained:

no corrosion, therefore no slush forming or clogging;

the guarantee of obtaining the density of extinguishing water required;

no development of microorganisms;

no water leaks possible (as the water is by default absent in the pipes of the installation that lead to the sprinklers);

no need for antifreeze agent or anticorrosion treatment;

no rinsing required before the installation is put into service.

Furthermore, as shall be explained in more detail in what follows, the time for putting an installation with a "vacuum" system into service takes place extremely quickly, under about one minute.

In vacuum systems, the tripping, i.e. the filling with water of the network of sprinklers, is obtained using a device comprising an actuator.

Such an actuator comprises a body in which exits a water inlet duct and a water outlet duct able to be placed in communication with each other.

A member of the actuator is able to move between two positions, namely:

a position preventing the placing into communication of the two ducts, which corresponds to maintaining the network of sprinklers in a vacuum;

a position that authorises the placing into communication of the water inlet duct with the water outlet duct, which trips the filling with water of the network of sprinklers.

Such an actuator is in particular described in patent document published under number FR-2 724 323.

In reference to FIG. 1, the actuator of prior art described by patent document FR-2 724 323 comprises a cylinder body C having:

an axial body C1, communicating with the vacuum network of sprinklers;

a water inlet duct C2;

a water outlet duct C3, communicating with the tripping circuit of the filling with water of the network of sprinklers.

In standby position of the installation (therefore in the absence of a fire), an ogive O seals off the three ducts, C1, C2 and C3.

Furthermore, a spring R is mounted in the body C of the actuator, with this spring R being mounted in traction and coupled to the ogive O in such a way that the spring tends to pull the ogive outside its shutting-off position.

As such, when the network of sprinklers is in a vacuum, it draws the ogive in a shutting-off position of the duct C1, with a force exceeding that calibrated in a predetermined manner of the spring R. On the other hand, when the network of sprinklers is placed under atmospheric pressure (by the blowing of a fusible member of at least one of the sprinklers of the installation), the drawing force of the ogive is suppressed and the spring pulls the ogive (towards the left in FIG. 1), which links ducts C2 and C3, leading to the tripping of the installation.

However, it was observed that, in the case of shocks or vibrations (for example due to water hammers, light deflagrations subsequent to the passing of vehicles . . . ), the ogive can leave, even furtively, its shutoff position, which can be enough for the spring R to exert a pulling that is greater than the drawing power initially present in the duct C1. The actuator then takes its position that authorises the tripping of the filling with water of the installation.

Of course, in such a situation, no sprinkler has its fusible member blown, and therefore no flow of water takes place. However, it is necessary to call upon a technician to proceed with putting the installation back into service, i.e. emptying the network of sprinklers and placing it in a vacuum, then putting the installation back into service.

Furthermore, when the installation is put into service, such an actuator of prior art is not very practical. Indeed, it is necessary to push the ogive towards the duct C1 and to maintain this pressure until the vacuum in the duct C1 is enough to generate a drawing on the ogive that is greater than the force of the spring R, and therefore the maintaining in shutting-off position of the latter.

SUMMARY

An exemplary embodiment of the present disclosure relates to a firefighting installation, including a network of vacuum sprinklers, with the installation integrating a trip device for the filling with water of the network of sprinklers, with the trip device comprising at least one actuator comprising a body in which exits a water inlet duct and a water outlet duct able to be placed in communication, a member of the actuator being able to authorise/prevent the putting into communication of the water inlet duct with the water outlet duct in such a way that the preventing of the putting into communication of the two ducts maintains the network of sprinklers under a vacuum while the putting into a communication of the two ducts trips the filling with water of the network of sprinklers.

According to the invention, the trip device is characterised in that it comprises:

a master actuator sensitive to the pressure present in the sprinkler network and capable of moving a yoke from a first to a second position;

a locking means for locking a member of the actuator in position that prevents the putting into communication of two ducts;

a transmission member between said yoke and said locking means able to allow the member of the actuator to pass into the position that allows for the putting into communication of the two ducts when the yoke is in said second position, said master actuator comprising a membrane able to move between a first position corresponding to the sprinkler network being under vacuum and a second position corresponding to the sprinkler network being subject to atmospheric pressure, said first and second positions of the membrane corresponding to said first and second positions of the yoke.

As such, thanks to the invention, the structural means of the trip device is dissociated into two portions, namely:

one constituted of the master actuator, sensitive to the pressure present in the sprinkler network, and able to initiate the tripping (the filling with water) of the installation;

the other, receiving the information from the master actuator, and controlling the putting into communication of two ducts of the actuator able to control the filling with water of the network of sprinklers.

These two functions were combined in the ogive of the actuator of prior art.

According to the invention, by dissociating the two functions, slight variations are possibly authorised in the state of the master actuator, without this directly and automatically causing the change in the state of the actuator.

Untimely tripping of the installation is in this way avoided.

Moreover, as shall appear more clearly in what follows, during the putting into service of the installation, the implementation of the trip device is done automatically by the placing of the sprinkler network in a vacuum.

In addition, with the membrane of the master actuator, and as shall appear more clearly in what follows, a member is obtained that can be sized in such a way as to simultaneously provide:

- the seal between the upstream and the downstream of the membrane;
- good reactivity and a satisfactory amplitude of the change in state, by a suitable sizing of the membrane in such a way that it has an optimal surface.

In this case, said membrane is advantageously mounted in an enclosure, in such a way as to form a sealed deformable partition between two passages opposite one another arranged in the enclosure, namely a primary duct that communicated with the sprinkler network and a secondary passage throughout which a shaft coupled to the yoke can slide, said shaft being made integral with the membrane and a ballast.

The enclosure is advantageously delimited by a bell and a closure disc, with the membrane being pinched between the bell and the disc.

According to a particular embodiment, said shaft is also coupled to a spring intended to push the membrane towards the second position.

Advantageously, said spring is mounted in compression bearing on a thumbwheel that can be adjusted in position on said shaft.

As such, it is possible to adapt the force exerted by the spring, for the purpose of adjusting the reactivity of the master actuator.

According to a particular embodiment, the locking means comprises a tipping locking spacer mounted at an end of a pivoting lever connected by the other of its ends to the yoke.

In this way, a mechanical unit linked to locking/unlocking is obtained which can be carried out in such a way as to involve travel such that the tripping of the device cannot be generated by simple variations or shocks that are exerted on the master actuator.

In this case, the lever is advantageously mounted pivoting on the actuator.

According to a preferred embodiment, the actuator comprises a piston able to move in a cavity of the body, and has an external portion extending outside of said cavity and being provided with a ring whereon the locking means is intended to act.

In this case, a spring is advantageously mounted in the cavity of the body of the actuator in such a way as to push the piston outside of the cavity when the yoke is in said second position.

Such an arrangement makes it possible to obtain a change in the state of the actuator in an instantaneous or practically instantaneous manner.

Preferentially, the spring has a first end that cooperates with the piston and a second end, opposite the first, bearing on a plate of the body, said plate having a central finger whereon the spring is threaded.

In this way, a radial positioning of the spring is obtained, whether it is in tensioned or untensioned state. It is thus prevented from taking a deformation, for example in the direction of a longitudinal curvature, which could hinder the proper operation of the actuator, for example by slowing down the change in the state of the actuator during the tripping of the installation.

According to another characteristic of the invention, the actuator comprises a piston that can move in a cavity of the body and the water inlet duct communicates with a pipe that controls the general valve for the filling with water of the sprinkler network, with the general valve being closed when the control pipe is filled with water under pressure and open when the control pipe is not pressurised, with the piston being able to move between a shutoff position and the inlet duct maintaining the pressure in the control pipe and a released position that allows for the putting into communication of the inlet duct with the outlet duct.

According to a first advantageous embodiment, the outlet duct communicated with a water bleed circuit.

According to a preferred embodiment, the actuator comprises a piston that can move in a cavity of the body, with the body having a first end through which the piston can be displaced, and a second end opposite the first, with the outlet duct being arranged in the second end or between the outlet duct and the second end, with the outlet duct communicating with a circuit at atmospheric pressure.

Such an outlet duct, positioned in this way and at atmospheric pressure, tends to favour the displacement of the piston, in particular at the very start of its change in state in order to move towards the tripping position.

According to another characteristic of the invention, the actuator comprises a piston that can move in a cavity of the body, with a third duct being arranged in the body and able to be placed in communication with the inlet duct in said second position of the yoke, with the third duct communicating with a hydraulic alarm circuit.

As such, the actuator according to the invention makes it possible to trip simultaneously, or practically simultaneously, the filling with water of the sprinkler network and the activation of the hydraulic alarm.

The invention also relates to a trip device for the filling with water of a network of sprinklers in a vacuum system, comprising at least one actuator comprising a body in which exits a water inlet duct and a water outlet duct able to be placed in communication, a member of the actuator being able to authorise/prevent the putting into communication of the water inlet duct with the water outlet duct in such a way that the preventing of the putting into communication of the two ducts maintains the network of sprinklers under a vacuum while the putting into a communication of the two ducts trips the filling with water of the network of sprinklers, characterised in that it comprises:

- a master actuator sensitive to pressure present in the sprinkler network and able to move a yoke between a first and a second position, said master actuator comprising a membrane able to move between a first position corresponding to the sprinkler network being under vacuum and a second position corresponding to the sprinkler network being subject to atmospheric pressure, said first and second positions corresponding to said first and second positions of the yoke;
- a locking means for locking a member of the actuator in position that prevents the putting into communication of two ducts;
- a transmission member between said yoke and said locking means able to allow the member of the actuator to pass into the position that allows for the putting into communication of the two ducts when the yoke is in said second position.

BRIEF DESCRIPTION OF THE DRAWINGS

Other characteristics and advantages of the invention shall appear more clearly when reading the following description of a preferred embodiment of the invention, given by way of a simple example for the purposes of information and non-restricted, and of the annexed drawings among which.

DETAILED DESCRIPTION OF ILLUSTRATIVE EMBODIMENTS

Figure 1:
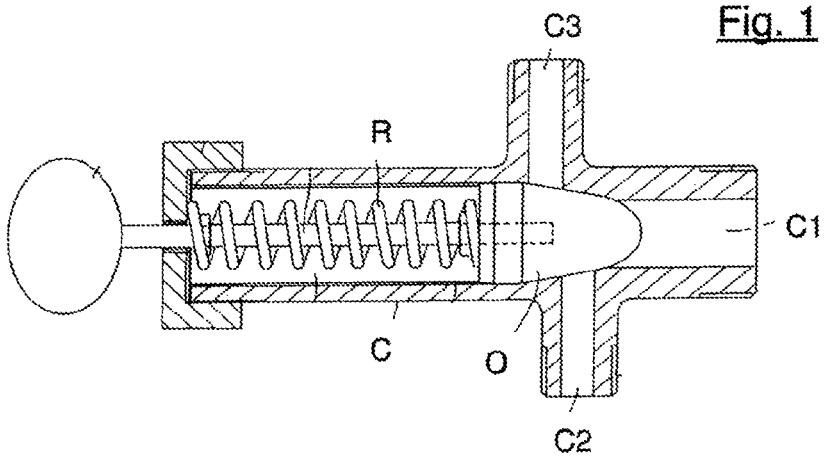
FIG. 1 is a view of an actuator according to prior art.
Figure 2:
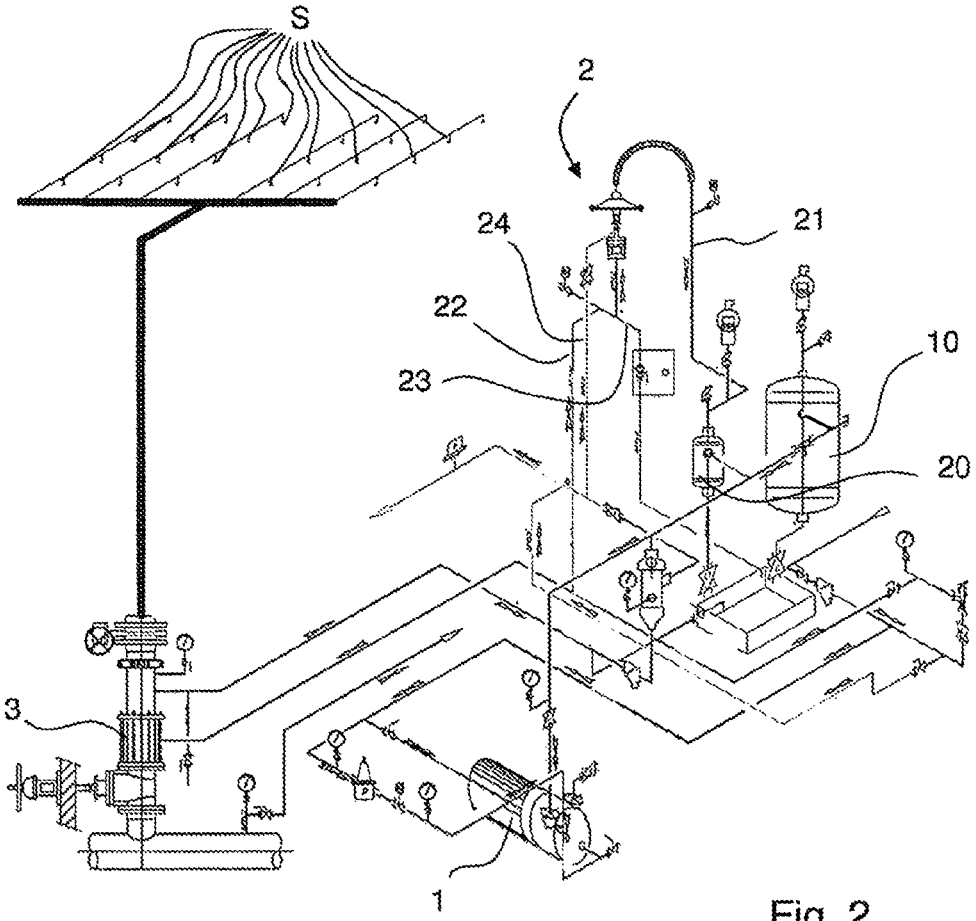
FIG. 2 diagrammatically shows a firefighting installation according to the invention.

In reference to FIG. 2, a firefighting installation according to the invention comprises:

- a network of sprinklers S intended to be kept under vacuum when on standby (i.e. in the "non-fire" configuration of the installation);
- a vacuum pump 1 connected to the network of sprinklers S;
- a regulation tank 10;
- a trip device 2 connected to the vacuum circuit and to the vacuum pump 1 by the intermediary of a trip bottle 20;
- a general valve 3 known to those skilled in the art by the designation "Inbal" (registered trademark), controlled by the trip device 2, and intended, in case of fire, to allow water to be supplied to the network of sprinklers S.

According to a known principle of this type of installation, of which the principle has been described in patent document published under number FR-2 724 323, the putting into service of such an installation calls for placing the network of sprinklers (S) under vacuum, with a vacuum as such also being present in the line 21 that leads to the trip device 2. As long as a vacuum is present in this line 21, the trip device 2 keeps under pressure with water the control chamber of the general valve 3, which maintains the latter in a closed position. If the fusible member of one of the sprinklers blows, the network of sprinklers S is placed under atmospheric pressure, which also propagates to the level of the line 21, which switches the state of the trip device 2, which then authorises, as shall be described in more detail in what follows, the drop in pressure in the control chamber of the general valve 3, which will provoke the opening of the latter and the filling with water of the network of sprinklers S.

Figure 3:
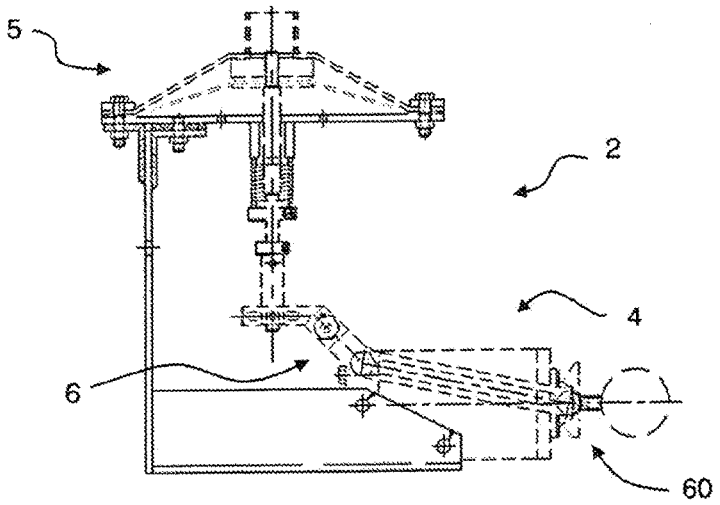
FIG. 3 is a view of a trip device intended to be provided on an installation according to the invention.

In reference to FIG. 3, the trip device 2 provided on an installation according to the invention comprises:

- an actuator 4;
- a master actuator 5 connected to the line 21 mentioned hereinabove, with the master actuator being intended to be sensitive to the pressure present in the sprinkler network for the purposes of displacing a yoke from a first to a second position such as described hereinafter.

Figure 4:
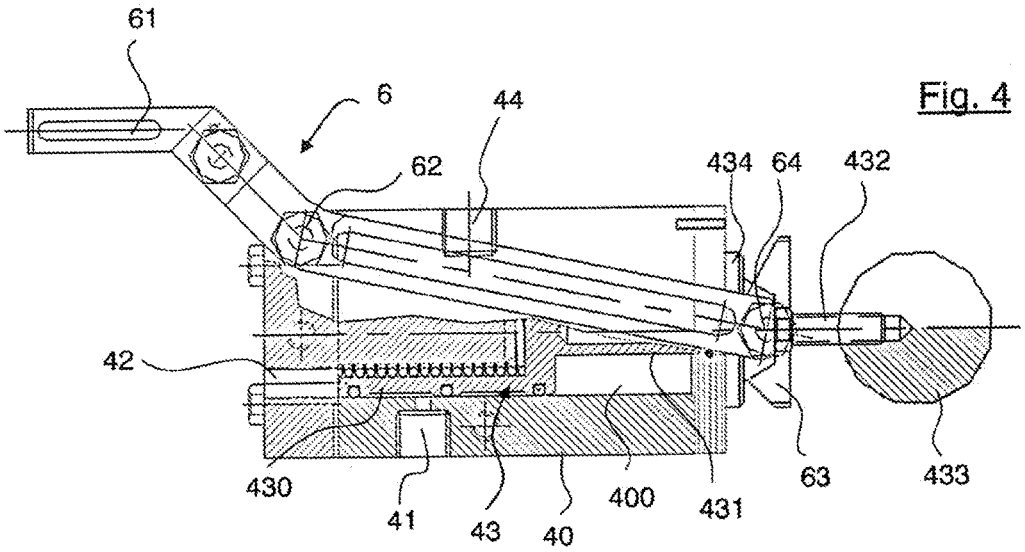
FIGS. 4 and 5 diagrammatically show an actuator of a trip device according to the invention, respectively in standby position and in tripped position of the installation.
Figure 5:
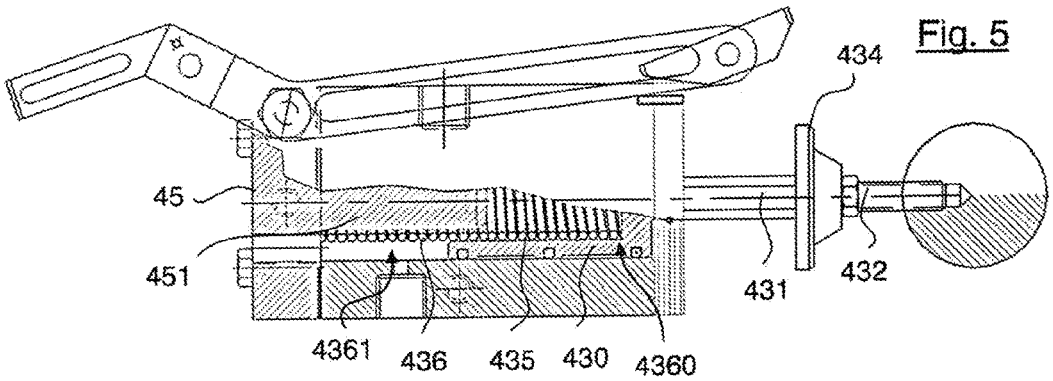

In reference to FIGS. 4 and 5, an actuator intended to be integrated into an installation according to the invention comprises a body 40, in the form of a cylinder, having a central cavity 400, and wherein exits a water inlet duct 41 as well as a water outlet duct 42, with both ducts able to be placed in communication with one another.

The actuator further integrates a piston 43, constituting a member of the actuator able to authorise/prevent the placing into communication of the duct 41 with the duct 42.

According to the operating principle of a firefighting installation implementing a network of vacuum sprinklers such as recalled previously, the water inlet duct communicates with a control pipe 22 connected to a control chamber of the general valve 3 (FIG. 2), with the latter being closed when the control pipe 22 is filled with water under pressure and open when the control pipe is not pressurised.

The water outlet duct 42 communicates with a water bleed circuit 23, at atmospheric pressure.

As such, the piston 43 of the actuator can move between a shutoff position of the duct 41, which maintains the pressure in the control pipe 22 (resulting in a closed position of the general valve 3), and a released position that allows for the putting into communication of the water inlet duct 41 with the water outlet duct 42, which then causes the pressure to drop in the control chamber of the general valve and provokes the opening of the latter, and therefore the filling with water of the sprinkler network.

Such as shown in FIGS. 4 and 5, the body 40 of the actuator further has a third duct 44, able to be placed in communication with the water inlet duct 41 when the piston 43 is in the tripped position, such as shown in FIG. 5. This third duct 44 communicates with a hydraulic alarm circuit 24 (FIG. 2)

Such as shown in FIGS. 4 and 5, the piston 43 comprises a shutting-off portion 430, which is extended by a shaft 431 of which an external portion 432 extends outside the body 40 of the actuator. This portion 432 has at its end a grasping ball 433. Furthermore, the portion 432 has, outside the body of the actuator, a ring 434, bearing against the body of the actuator in standby position of the latter.

In addition, the shutting-off portion 430 of the piston has a central recess 435 forming a housing for a spring 436, mounted in the body of the actuator in such a way as to push the piston 43 outside the cavity during the change in state of the actuator. According to the configuration shown in FIGS. 4 and 5, the spring 436 is therefore mounted in compression in the central recess of the shutting-off portion of the piston, in the standby position of the actuator, such as shown in FIG. 4.

Furthermore, in reference to FIG. 5, the spring 436 has a first end 4360 housed in the central recess of the shutting-off portion of the piston, and intended to cooperate with the latter, while the second end 4361 of the spring, opposite the first, bears on a plate 45 constituting the bottom of the body of the actuator. This plate has a central finger 451 whereon is threaded the end 4361 of the spring.

With such a mounting, the piston is advantageously guided in translation on the one hand on its shaft 431 and, on the other hand, thanks to the spring 436.

According to this embodiment, the water outlet duct 42 is arranged in the plate 45 and is connected, as indicated hereinabove, to a bleed circuit 23, placed under atmospheric pressure in the standby position of the installation.

Note that the rear portion of the piston able to be in contact with the plate 45 has reliefs intended to prevent any suction effect between the piston and the plate.

The master actuator 5 of a trip device according to the invention is described hereinafter in reference to FIGS. 6 and 7.

Figure 6:
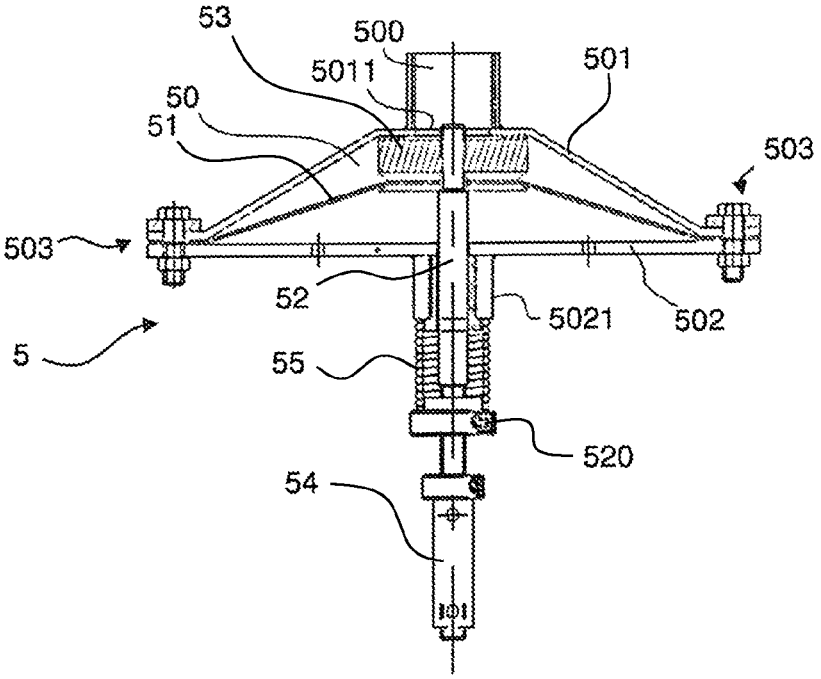
FIGS. 6 and 7 diagrammatically show a master actuator a trip device according to the invention, respectively in standby position and in tripped position of the installation.
Figure 7:
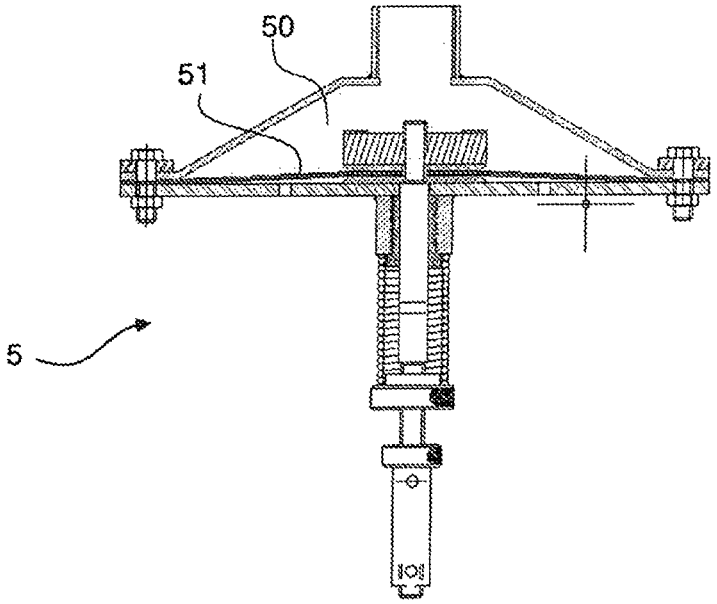

As shown in these figures, a master actuator according to this embodiment of the invention comprises:

- an enclosure 50 delimited by a bell 501, closed at its base by a closure disc 502, with these two elements delimiting the enclosure being made integral with one another by means of screwing 503 distributed in a peripheral manner around the enclosure;

- a membrane 51, able to move between a first position corresponding to a vacuum state of the sprinkler network, such as shown in FIG. 6, and a second position corresponding to a placing under atmospheric pressure of the sprinkler network, such as shown in FIG. 7;
- a shaft 52 fixed to the membrane 51, in central position of the latter;
- a ballast 53 borne at the end of the shaft 52, and integral with the shaft 52 as well as with the membrane 51;
- a yoke 54, in the extension of the shaft 52 outside the enclosure 50.

The membrane 51 is mounted in the master actuator in such a way that it is pinched between the bell 501 and the disc 502, and this over the entire periphery of the membrane. It is understood that, according to this mounting, the entire surface of the membrane, or practically all of this surface, is exposed to the pressure present in the enclosure 50. The membrane therefore constitutes the sensitive member of the master actuator, able to generate the change in state of the latter under the effect of the change in pressure in the enclosure. And only the blowing of the fusible member of a sprinkler can result in a change in pressure in the enclosure, contrary to the actuator of prior art in which the chamber is at atmospheric pressure, which, in the case of a slight movement of the ogive under the effect of shocks or vibrations, allows for a change in the state of the actuator.

The master actuator is intended to act on the actuator 4 by a displacement of the yoke 54, from a first position to a second position, with the first position of the yoke corresponding to the first position of the membrane 51 shown in FIG. 6, and with the second position of the yoke corresponding to the second position of the membrane shown in FIG. 7.

The bell 501 has in its upper portion an opening 5011 that places into communication the inside of the enclosure 50 with a primary duct 500 connected to the line 21 shown in FIG. 2.

Note that the ballast 53 has reliefs on its upper surface intended to prevent the ballast from constituting a shutoff valve of the primary duct 500, in the standby position of the master actuator corresponding to the first position of the membrane and of the yoke. In this way the risk is overcome that the ballast remains thrust at the inlet of the primary duct, via a suction effect, which would result in a failure of the tripping.

The disc 502 has a secondary passage 5021 through which the shaft 52 coupled to the yoke 54 can slide.

Such as shown in FIGS. 6 and 7, a spring 55 is in contact by one of its ends with the shaft 52, by the intermediary of a thumbwheel 520 and, by the other of its ends, with the end of the secondary passage 5021. In the position shown in FIG. 6, the spring 55 is compressed and tends to exert on the shaft 52, by the intermediary of the thumbwheel 520, a force directed downwards that is combined with that of the ballast 53. in the position shown in FIG. 7, the spring is at rest.

With this mounting, a sufficiently substantial force is obtained to trip the master actuator and switch the state of the actuator, and this despite the reaction force of the actuator due to the action of its own spring 436 which tends to maintain the ring 434 very firmly against the means of locking, which then tends to oppose the unlocking.

Of course, the force of the spring 55 is calibrated according to the weight of the ballast. Furthermore, the compression of the spring 55 can be pre-adjusted by modifying the position of the thumbwheel 520, with the position of the latter able to be modified along the shaft 52.

In reference to FIGS. 3 to 7, the interaction of the master actuator of a trip device is described hereinafter according to the invention.

In reference to FIG. 3, note that the yoke 54 is coupled to a lever 6. To do this, the lever 6 has at one of its ends an oblong hole 61 wherein a lug 540 provided at the lower end of the yoke 54 can slide.

The lever 6 has at its end opposite the oblong hole 61 a means of locking 60, intended to maintain the actuator in the position shown in FIG. 4 or, inversely, release the latter in such a way that it can be displaced towards and to the position shown in FIG. 5.

The means of locking 60, in locked position, act on the ring 434 borne by the shaft 431 of the piston.

The lever is pivoting between the position shown in FIG. 4 and the position shown in FIG. 5. For this, the lever 6 is mounted pivoting around an axis 62 borne by the body 40 of the shutoff valve.

Note that the position of the shaft 62 is notably closer to the end of the lever on the yoke side than that of the side of the means of locking, this in such a way as to increase as much as possible the amplitude of the displacement of the lever at the end of the lever on the side of the means of locking with respect to that of the yoke side.

Furthermore, the means of locking 60 has the form of a spacer 63 mounted pivoting at the end of the lever 6 around a shaft 64.

As such, during the pivoting of the lever 6 from the position shown in FIG. 4 to the position shown in FIG. 5, the means of locking 60 can pivot around its shaft 64, as such authorising the circular displacement of the corresponding end of the lever, and making it possible to be released from the locked position.

The locking spacer can take the form of a head that has an inverted U-shaped cut-out wherein the external portion 432 of the piston is housed in locked position.

The operation of the trip device is as follows.

When the duct 500 is at atmospheric pressure, the shutoff valve constituted by the ballast 53 falls towards the disc 502, drawing the membrane 51, and displacing, through the intermediary of the shaft 52, the yoke 54 downwards. The lug 540 of the yoke 54 present in the oblong hole 61 then pushes the corresponding end of the lever downwards, causing the pivoting of the lever 6 around its shaft 62 and, consequently, the rising of the locking spacer 63 upwards, simultaneously with the tipping of the latter around its shaft 64. It is understood that the lever acts as a transmission member between the yoke and the means of locking in position of the piston of the actuator.

The piston 43 of the actuator is then released and the spring 432 pushes the piston to the position shown in FIG. 5, in the tripping position of filling the sprinkler network with water.

The course of the piston is provided such that the duct 41 communicated on the one hand with the water outlet duct 42 and, on the other hand, with the third duct 44.

This then leads to a flow of water under pressure present in the duct 41 to the conduct 42 and to the conduct 44, causing a drop in the pressure in the control duct 22 and a tripping of the hydraulic alarm connected to the third duct 44.

Figure 8:
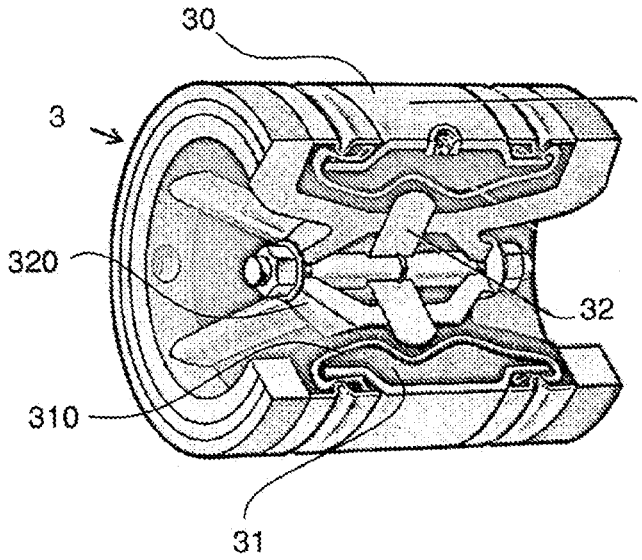
FIG. 8 is a diagrammatic view of a general valve for filling the sprinkler network with water controlled by a trip device according to the invention.

The drop in pressure in the control duct causes the change in state of the general valve 3, described hereinafter in reference to FIG. 8.

Such as shown in this figure, such as general valve 3, known by those skilled in the art under the designation "Inbal valve" comprises:

an external body 30;

a control chamber 31, extending inside the body 30, is delimited by a deformable sleeve 310;

a sealing disc 32, occupying a central position inside the body 30 of the valve, and being borne by a support unit 320.

When the water under sufficient pressure is present in the control chamber 31, the sleeve 310 is applied against the sealing disc 32, which corresponds to the closed position of the general valve 3.

In this position, water under pressure is contained on one side of the valve.

When the pressure falls in the control chamber 31, the pressure at the inlet of the valve pushes the sleeve 310 towards the internal wall of the valve, opening the passage and allowing for the flow through the valve.

This opening corresponds to the tripping of the installation in case of fire, and the opening of the valve allows for the filling of the sprinkler network with water.

An exemplary embodiment of the disclosure proposes a firefighting installation, of the type implementing a vacuum network of sprinklers, which is not or is hardly subject to untimely tripping.

An exemplary embodiment provides such an installation that makes it possible to put it into service quickly and practically.

Although the present disclosure has been described with reference to one or more examples, workers skilled in the art will recognize that changes may be made in form and detail without departing from the scope of the disclosure and/or the appended claims.

The invention claimed is:

1. A fire fighting installation, comprising:

a network of vacuum sprinklers; and a trip device for filling the network of sprinklers with water, the trip device comprising:

at least one first actuator comprising a body which has a water inlet duct, a water outlet duct, and a member which is movable between a closed position that prevents water communication between the water inlet duct and the water outlet duct, and a tripped position that permits water communication between the water inlet duct and the water outlet duct, wherein the closed position maintains the network of sprinklers under a vacuum, and wherein the tripped position trips the filling with water of the network of sprinklers;

a yoke movable between a first position and a second position;

a master actuator sensitive to pressure present in the network of sprinklers and coupled to move the yoke between the first and the second position;

a lock, which locks the member of the first actuator in the closed position that prevents water communication between the water inlet duct and the water outlet duct; and a transmission member between said yoke and said lock, which moves the lock to allow the member of the first actuator to pass from the closed position to the tripped position that permits water to flow from the water inlet duct to the water outlet duct when the yoke is in said second position, wherein said master actuator comprises a membrane that is movable between a first position corresponding to the network of sprinklers being under vacuum and a second position corresponding to the network of sprinklers being subject to atmospheric pressure, said first and second positions of the membrane corresponding to said first and second positions of the yoke.

2. The fire fighting installation according to claim 1, wherein said master actuator comprises:

a shaft coupled to the yoke;

an enclosure comprising a primary duct and a secondary passage, wherein the membrane is mounted in the enclosure in such a way as to form a sealed deformable partition between the primary duct and the secondary passage, which are arranged in the enclosure opposite to one another, wherein the primary duct communicates with the sprinkler network and the shaft slides through the secondary passage, said shaft being secured with the membrane and a ballast.

3. The fire fighting installation according to claim 2, wherein the enclosure is delimited by a bell and a closure disc, with the membrane being pinched between the bell and closure disc.

4. The fire fighting installation according to claim 2, wherein said shaft is also coupled to a spring configured to push the membrane to the second position.

5. The fire fighting installation according to claim 4, wherein said spring is mounted in compression bearing on a thumbwheel that can be adjusted in position on said shaft.

6. The fire fighting installation according to claim 1, wherein the transmission member comprises a pivoting lever having one end connected to the yoke, and wherein the lock comprises a tipping locking spacer mounted at another end of the pivoting lever.

7. The fire fighting installation according to claim 6, wherein the pivoting lever is pivotally clamped on the first actuator.

8. The fire fighting installation according to claim 1, wherein the body of the first actuator comprises a cavity, and wherein the member of the first actuator comprises a piston able to move in the cavity of the body and comprises an external portion extending outside of said cavity and being provided with a ring whereon the lock acts.

9. The fire fighting installation according to claim 8, wherein the first actuator further comprises a spring mounted in the cavity in such a way as to push the piston outside of the cavity when the yoke is in said second position.

10. The fire fighting installation according to claim 9, wherein the piston has a central recess forming a housing for a portion of the spring.

11. The fire fighting installation according to claim 9, wherein the spring has a first end that cooperates with the piston and a second end, opposite the first, bearing on a plate of the body, said plate having a central finger whereon the spring is threaded.

12. The fire fighting installation according to claim 1, wherein:

the first actuator comprises a cavity in the body and the member comprises a piston that can move in the cavity of the body;

the installation further comprises a general valve and a control pipe, which is coupled to the water inlet duct of the first actuator, wherein the control pipe controls the general valve for the filling of the network of sprinklers with water, with the general valve being closed when the control pipe is filled with water under pressure and open when the control pipe is not pressurised, and the member of the first actuator is movable between the closed position in which the member maintains the pressure in the control pipe, and the tripped position in which the member releases the pressure in the control pipe by permitting water to flow from the water inlet duct to the water outlet duct.

13. The fire fighting installation according to claim 1, further comprising a water bleed circuit, wherein the water outlet duct communicates with the water bleed circuit.

14. The fire fighting installation according to claim 1, wherein the body comprises a cavity and the member of the first actuator comprises a piston is movable in the cavity between the closed position and the tripped position, with the body having a first end through which the piston can be displaced, and a second end opposite the first end, with the water outlet duct being arranged in the second end or between the water inlet duct and the second end, with the outlet duct communicating with a circuit at atmospheric pressure.

15. The fire fighting installation according to claim 1, further comprising:

a hydraulic alarm circuit; and wherein the body comprises a cavity and the member of the first actuator comprises a piston that is movable in the cavity; and wherein the body comprises a third duct, which is coupled to the hydraulic alarm circuit and is arranged in the body such that water communicates between the water inlet duct and the third duct when the member is in the tripped position and the yoke is in the second position.

16. A trip device for filling a network of sprinklers with water in a vacuum system, comprising:

at least one first actuator comprising a body which has a water inlet duct, a water outlet duct, and a member which is movable between a closed position that prevents water communication between the water inlet duct and the water outlet duct, and a tripped position that permits water communication between the water inlet duct and the water outlet duct, wherein the closed position maintains the network of sprinklers under a vacuum, and wherein the tripped position trips the filling with water of the network of sprinklers;

a yoke movable between a first position and a second position;

a master actuator sensitive to pressure present in the network of sprinklers and coupled to move the yoke between the first and the second position, said master actuator comprising a membrane that is movable between a first position corresponding to the network of sprinklers being under vacuum and a second position corresponding to the network of sprinklers being subject to atmospheric pressure, said first and second positions of the membrane corresponding to said first and second positions of the yoke;

a lock, which locks the member of the first actuator in the closed position; and a transmission member between said yoke and said lock, which moves the lock to allow the member of the first actuator to pass from the closed position to the tripped position that permits water to flow from the water inlet duct to the water outlet duct when the yoke is in said second position.

* * * * *